United States Patent [19]

Armstrong

[11] Patent Number: 4,765,152

[45] Date of Patent: Aug. 23, 1988

[54] BEVERAGE DISPENSER WITH A PARTITIONLESS REFRIGERATING STAND

[75] Inventor: Alfred Armstrong, Norwood, Mass.

[73] Assignee: Crathco, Inc., Canton, Mass.

[21] Appl. No.: 37,944

[22] Filed: Apr. 13, 1987

[51] Int. Cl.[4] ..... B67D 5/62

[52] U.S. Cl. ..... 62/389; 62/507; 222/146.6

[58] Field of Search ..... 62/389, 428, 507; 222/146.6

[56] References Cited

U.S. PATENT DOCUMENTS

| | | | |
|---|---|---|---|
| 2,304,359 | 12/1942 | Hommel | 62/428 X |
| 2,674,106 | 4/1954 | Hill | 62/389 X |
| 2,920,464 | 1/1960 | Trask | 62/428 |
| 3,468,370 | 9/1969 | Castillo | 62/389 X |
| 3,822,565 | 7/1974 | Arzberger | 62/392 |
| 3,839,880 | 10/1974 | Premaza | 62/428 X |

*Primary Examiner*—William E. Tapolcai

*Attorney, Agent, or Firm*—James E. Mrose

[57] ABSTRACT

In a compact beverage dispenser of the type in which the conditioned beverage is chilled and displayed in a plastic bowl atop a stand which houses a compression system of refrigeration, ambient air intake is fan-driven through and along the heat-exchange fins of a condenser grid which extends horizontally fully across spaces between lateral sidewalls of the stand. A single vertical-axis motor both pumps the beverage and rotates the refrigeration-system axial-flow fan in an upper region of the stand, above the horizontal condenser; a separately-motorized compressor package is disposed in the lower region of the stand, below the horizontal condenser, where it is bathed by heat-removing air flow forced downwardly by the fan in the upper region. Walls on at least two opposite sides of the stand are provided with openings allowing essentially free lateral flow of cooling air into and out of the upper and lower regions of the stand and between the condenser-grid fins; in a narrow-dispenser construction having an elongated rectangular condenser grid, fins necessarily lying beyond the periphery of the fan are actively swept by air forced laterally through the stand.

10 Claims, 2 Drawing Sheets

BEVERAGE DISPENSER WITH A PARTITIONLESS REFRIGERATING STAND

BACKGROUND OF THE INVENTION

The present invention relates to improvements in apparatus for chilling and dispensing beverages, and, in one particular aspect, to novel and improved arrangements for effective air-cooling of a refrigeration-and-circulation system housed in the stand of a miniaturized beverage dispenser which supports a transparent storage-and-display tank, the laterally-apertured stand having a horizontal condenser grid of tubes and fins which, without accessory partitioning, divides the stand interior into two compact stacked housing regions, the upper of which includes a single axial-flow fan uniquely forcing air along advantageous flow paths through the condenser and laterally into and out of the stand.

Beverage-chilling dispensers have become well known in a variety of commercial forms which lend themselves to attractive countertop display of their contents to potential customers in such locations as stores, restaurants and soda fountains. Commonly, the dispenser units each include a small electrically-powered refrigeration system built into a stand or base and serving to chill the continuously-circulated contents of an exposed transparent storage tank set atop the stand. Both from aerating and aesthetic standpoints, it has been found useful to produce a fountain-like circulation of the beverage within the tank, and the motorized pumping associated with that circulation now conventionally involves the magnetic coupling of an impeller in the stored liquid with an electric drive motor isolated from it in the stand below. Efficiency in the compression system of refrigeration requires that there always be ample cooling of its condenser, and both the system compressor and the dispenser's beverage-pumping motor must be assured of avoiding temperature excesses by having their internally-generated heat carried off and dissipated harmlessly. Such cooling and heat-dissipation problems have been addressed elsewhere in constructions which typically utilize more than one motorized fan and/or which rely upon a relatlively large vertically-disposed condenser. The proportions and location of the condenser can be quite critical, because, in general, an important design objective is to minimize the amount of counter space either actually occupied by the dispenser or required to be kept free for adequate cooling circulation of the ambient air. In addition, proper flow of circulated air through the dispenser has in some instances required that costly and unwieldy partitioning or baffling be incorporated into its equipment-crowded base to eliminate pockets of stagnation and to help develop high-velocity coursing of air at sites where needed. Examples of prior beverage chillers and dispensers having fan-induced circulations of air about the mechanisms in their bases include those described in U.S. Pat. Nos. 2,734,357 and 3,060,702 and 3,255,609 and 3,822,565.

SUMMARY OF THE INVENTION

Accordingly, this invention is aimed at improving the means whereby operating mechanisms for a beverage-cooling dispenser may be arrayed very compactly and yet be reliably and efficiently vented forcibly both to promote satisfactory exercise of its refrigerating cycle and to prevent undue build-up of generated heat, all without entailing high cost and complexity. In one preferred embodiment, a rectangular grid-like array of tubing and fins which makes up the condenser component of a miniature compression system of refrigeration is horizontally interposed fully between side walls of a narrow rectangular-cross-section stand or base atop which a transparent beverage bowl is to be mounted. That condenser array divides the interior of the stand into upper and lower regions, the upper of which houses an axialflow fan, directly above and spanning the width of the condenser, driven about a vertical axis by an electric motor which also powers a pump used to circulate fluid in the bowl; in the lower region, below the condenser array, is disposed a self-contained commercial compressor package. Opposite sidewall panels of the stand are kept open to flow of air essentially fully from top to bottom and front to back, by way of multiple perforations, louvers, or the like, while at least the front wall is substantially closed. Parallel fins by which heat is transferred away from the condensed tubing are aligned transversely, from side-to-side in relation to the opened opposite side panels, so that some of the circulated air will flow freely through them laterally, as well as vertically. Ambient air laterally of the upper portions of the two apertured side panels is drawn inwardly by the rotated fan, and a derived main stream is forced downwardly through the condenser and thence across and about the compressor package below until being dicharged laterally and somewhat downwardly from the lower portions of those apertured side panels. Those parallel condenser-grid fins which lie forwardly and rearwardly of reach of the axial-flow fan blades are nevertheless well swept by circulated air, which, in their case, is advantageously caused to traverse the stand in opposite lateral directions, respectively, through and along the parallel fins at the front and rear ends.

It is one of the objects of the present invention, therefore, to provide unique and improved beverage-cooling, displaying and dispensing apparatus of uncomplicated and economical construction which has a highly effective heat-exchange arrangement for the operating mechanisms housed in its stand, including a horizontal condenser dividing the stand into upper and lower regions and associated with an unbaffled air-circulating fan.

A further object is to provide a novel and mechanically-simple and compact arrangement for air-current removals of heat from stand-housed equipment of a refrigeration-type beverage dispenser, lateral intakes of ambient air being fan-driven vertically through a horizontal condenser without aid of auxiliary partitioning or ducting.

BRIEF DESCRIPTION OF THE DRAWINGS

Although the aspects of this invention which are considered to be novel are expressed in the appended claims, additional details as to preferred practices of the invention and as to further objects, advantages and features thereof may perhaps be most readily comprehended through reference to the following description taken in connection with the accompanying drawings, wherein:

DESCRIPTION OF THE PREFERRED EMBODIMENTS

Figure 1:
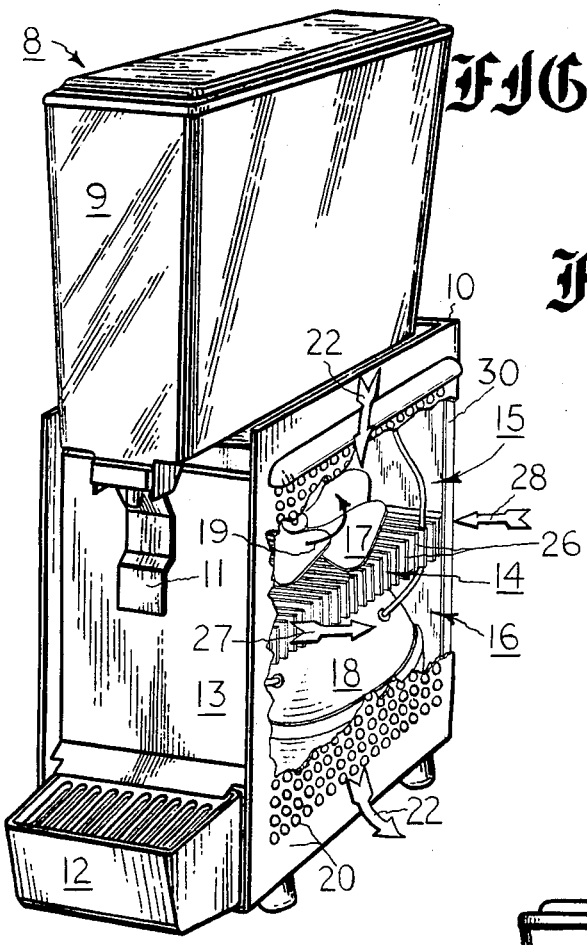
FIG. 1 is a pictorial representation of a preferred form of beverage cooler and dispenser unit having a perforated side panel of its narrow stand broken away to expose an upper fan drawing ambient air laterally inward and driving it through a horizontal condenser grid and downwardly across a compressor unit before lateral discharge.
Figure 2:
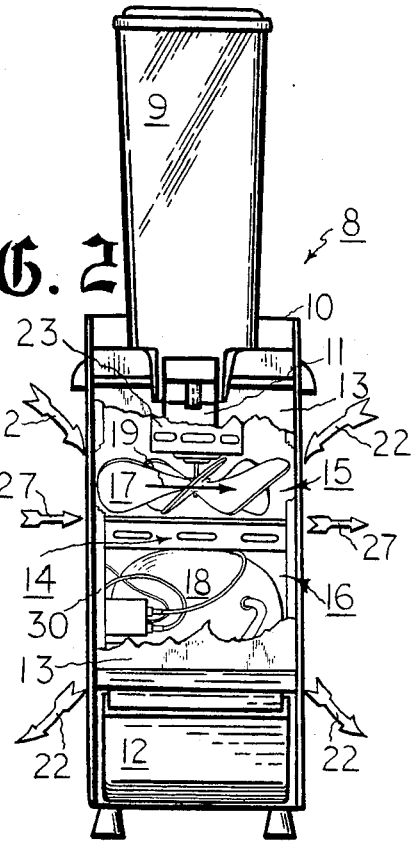
FIG. 2 presents a front elevation of the same unit, closed front portions of the stand being broken away to expose the same inner mechanisms and air flows.

Having reference to the drawings, wherein like reference characters designate identical or corresponding parts throughout the different views, and more particularly to FIG. 1 thereof, the miniaturized liquid-chilling, display and dispenser unit 8 illustrated there includes a combination of a transparent beverage bowl 9 atop and overhanging a stand or base 10 which accommodates cooling, circulating, control and other equipment appropriate to the automatic conditioning of juices, syrup drinks or other beverages which are to be merchandized from business locations at which accommodating countertop space is at a premium. Covered bowl 9 promotes aesthetic appeal by revealing its continuously-circulated liquid or liquid-solids contents, and, although released details are not visible in the drawings, a beverage-circulation impeller pump and suitable evaporation-coil provisions for chilling the beverage are located at the top of the stand and exposed to the bowl interior via a fitted and ring-sealed rimmed opening through the bottom of the bowl. My U.S. Pat. Nos. 3,269,606 and 4,505,409 may be referred to for exemplary details of such features, which are in general well known in the art, as well as for added details concerning other well-known dispenser features such as the depending front dispensing lever 11 and its cooperation with associated valving at an overhanging part of the bowl. Removable front tray 12 conveniently collects any overflow from cup fillings, in the usual way, and the front panelling 13 is closed to avoid any likelihood of contamination of mechanisms inside the stand.

Figure 3:
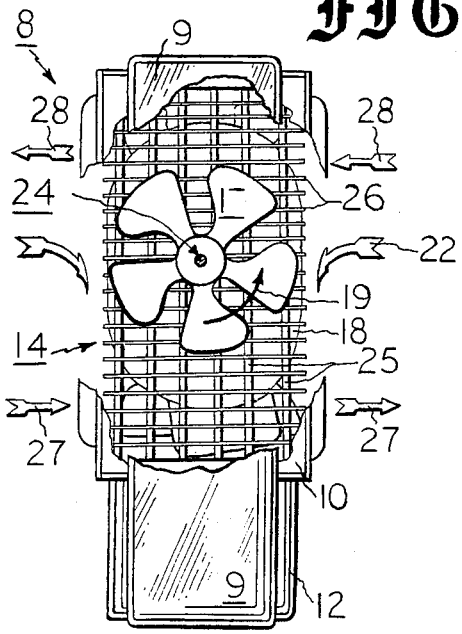
FIG. 3 is a top plan view of the same unit with both portions of the beverage bowl and upper portions of the stand being broken away.
Figure 6:
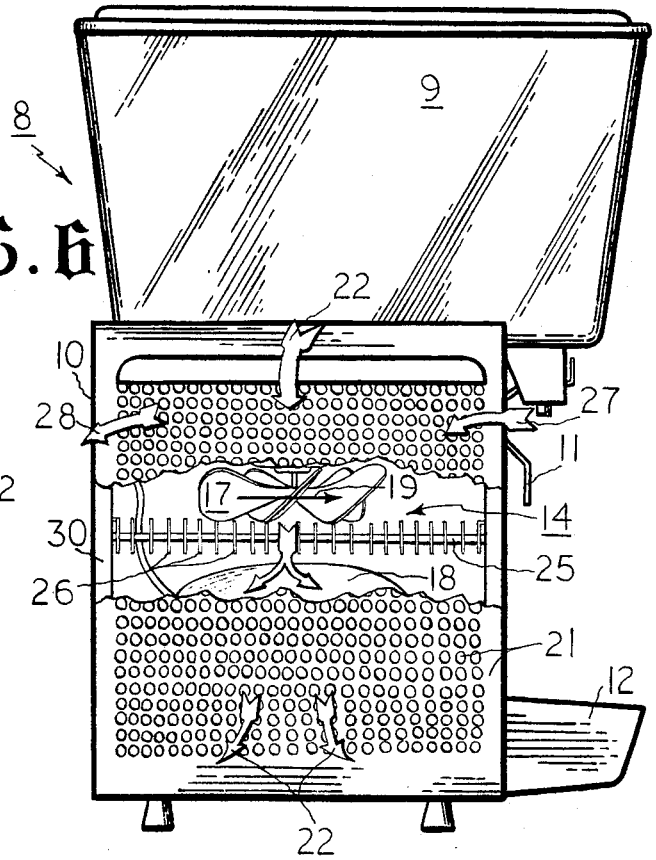
FIG. 6 provides a side elevational view looking toward the left side of the unit of FIG. 1, a portion of the perforated side panel being broken away.
Figure 4:
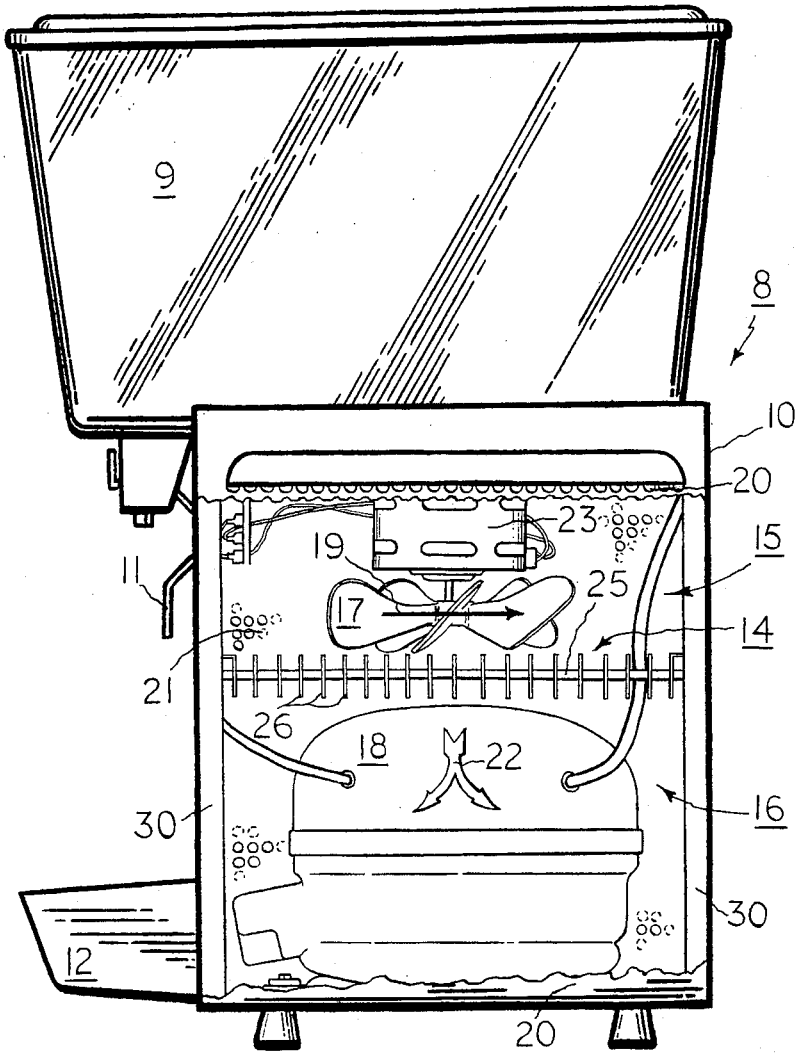
FIG. 4 provides a side elevational view looking toward the right side of the unit of FIG. 1, on a somewhat larger scale, and with the perforated side panel largely broken away.
Figure 7:
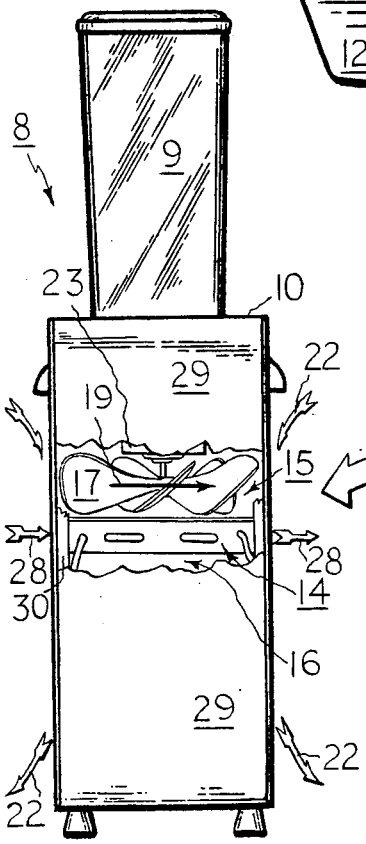
FIG. 7 is a rear view of the same unit, a portion of the closed back panel of the stand being broken away to reveal the interior arrangement of fan and horizontal condenser.

Merchandizer's interests in saving space occupied by such dispensers allow for their having a considerable depth but prescribe that they be kept narrow; however, if the usual vertical radiator-like condenser is disposed along either side of the stand, the resulting stand width is unavoidably made greater than would be liked, and, if such a condenser is instead disposed at the rear, then it would optimally be made quite narrow, with consequent forfeiture of heat-exchange area, and either a separate fan would have to be located there as well or special partitioning would probably have to be designed into the stand to improve the flow of air induced by a remote fan whose motor also operates the beverage-circulating pump. Quite differently, the condenser array of tubing and fins, 14, in the improved dispenser 8 is advantageously oriented substantially horizontally, rather than vertically, and, as is evident in FIG. 3, it is disposed such that it occupies substantially the full cross-section of the interior of the stand 10. Accordingly, it separates the stand interior into upper and lower regions, 15 and 16 respectively, between which intakes of ambient air may be driven by a fan 17 to draw heat away from that condenser and from the relatively bulky compressor package 18 mounted below. Arrow 19 in the various FIGURES characterized a counterclockwise rotation (as viewed from above) of the five-bladed axial-flow fan 17, which is preferably situated just above the fins of condenser 14, and that arrangement serves to draw ambient air in laterally through the many apertures of the perforated side panels 20 and 21 (FIGS. 1, 4 and 6) and then drives most of such air downwardly through the condenser and in a showering relation to compressor package 18 before it is discharged downwardly and outwardly through the same perforated side panels. Broad-area arrows such as 22 characterize those paths of air flow into, through and out of the stand.

Electric motor 23 (FIGS. 2, 4 and 7) rotates the fan 17 continuously whenever the dispenser unit is being operated, and it functions also to rotate a conventional impeller (not shown) which pumps the beverage in bowl 9. For the latter purpose, the vertical axis of motor and fan rotation, 24, is located substantiallly centrally of the somewhat narrow rectangular horizontal cross-section of the stand (FIG. 3), and the maximum diameter of the physical reach of the fan blades can be no greater than the relatively narrow width of the stand. As appears perhaps most plainly from FIG. 3, but also from FIGS. 1, 4, 5 and 6 as well, the condenser requires much area to be effective, and this calls for lengths of the tubing 25 and of the heat-radiating fins 26 of the condenser array 14 which will lie beyond such reach. Those end portions of the condenser array must nevertheless also be cooled well by flow of the circulated air, and satisfaction of that requirement is aided by the facts that the parallel fins 26 extend substantially transversely, i.e., from side to side, and that the apertured side panels 20 and 21 are open to lateral inlet and egress of air into and from between the end fins. With the illustrated type of fan, the aforesaid counterclockwise rotation induces crosswise-sweeping air flow from left to right over and between the front fins, as designated by broad-area arrows 27, and crosswise-sweeping air flow from right to left over and between the rearmost fins, as designated by broad-area arrows 28, (FIG. 5 especially, but also FIGS. 1–3 and 7). The closed front panel 13 and closed rear panel 29 (FIG. 7) also tend to channel such cross flows, although in some alternative constructions the rear panel may also be apertured to admit ambient air and the patterns of flow at the rear will then be modified from what is shown.

Figure 5:
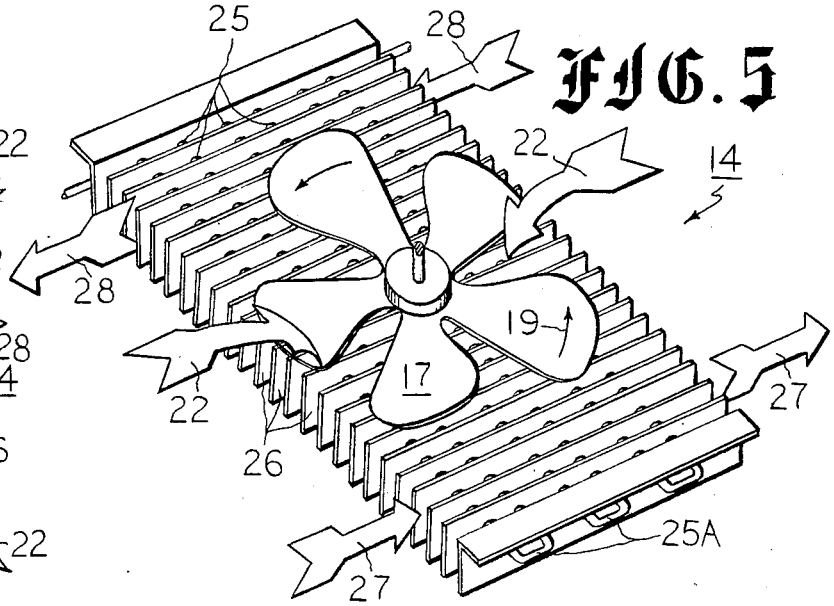
FIG. 5 illustrates, in perspective, a narrow horizontal condenser grid arrangement for a beverage dispenser unit such as that of the preceding Figures, together with a relatively small fan which circulates lateral intake of air both downwardly through central grid fins and transversely along and through end fins.

With the fins 26 arrayed transversely, the condenser tubing 25 which threads sinuously through them is of course longitudinal, between front and back of the unit, with end connections there (such as 26A in FIG. 5). Fins are a popular common expedient in the fashioning of a refrigeration-system condenser, but, if the condenser assumes some other form, equivalent results may be attained by allowing for air flow vertically through it, and where end portions are not within the span of the fan blades, by also arranging for the lateral crosswise sweeps of air to flow across and/or through those end portions. The condenser-coil tubing 25 provides enclosed passages for the flow of refrigerant in the compression-type refrigeration system, and the multiplicity of parallel fins 26 with which the sinuously-wound tubing is mated aids in the important heat-exchange relationship whereby refrigerant is to be well air-cooled to properly serve its role in the refrigeration cycle. Together, the laced tubing and fins form a substantially flat broad-area grid array whose rectangular outline complements the horizontal cross-section of the stand 10 which houses it; framework elements 30 support that grid array and the protective vertical sidewall panels 20, 21 and 13, 29 which enclose it. Other condenser hardware which will operate to cool the refrigerant efficiently because of heat exchange with circulated ambient air forced to flow vertically through it, may also be interposed substantially horizontally between the upper and lower regions of the stand to realize beneficial results without requiring that auxiliary baffling, partitioning or ducting be employed. However, preferred rectangular condenser constructions for use in units where the cooperaitng fan blades do not adequately span the longer dimension are those in which parallel spaced fins are elongated transversely in relation to that dimension and thus lend themselves to being swept crosswise by the circulated air.

The air-circulating fan 17 blades are preferably located just above the condenser, immediately below the electric pump-impeller motor 23 which also rotates it as well. In that arrangement, the fan is readily accessible and can be relied upon to cause rapid air flows in upper region 15 with attendant good venting of heat from the motor. Perforations, louvers or other lateral circulation openings through the metal or plastic side walls are located as fully from top to bottom and front to rear as conveniently possible, to avoid forming interior pockets in which air might stagnate rather than circulate, and those openings are of course of size and number accommodating the needed flow. Stands which are not rectangular in horizontal cross-section may utilize condensers which are of corresponding non-rectangular outline but which nevertheless occupy substantially all of the area between upper and lower regions of the stand. Similarly, the condensers need not be wholly thin and flat, nor disposed precisely horizontally, in order to function appropriately when deployed in accordance with these teachings. It should therefore be understood that the specific practices and embodiments described and shown herein have been presented by way of disclosure, rather than limitation, and that various modifications, combinations and substitutions may be effected by those skilled in the art without departure in spirit or scope from this invention in its broader aspect and as set forth in the appended claims.

What I claim as new and desire to secure by letters patent of the United States is:

1. Beverage-dispenser apparatus of the type including a storage bowl atop a stand housing components of a compression refrigeration system for chilling beverage in the bowl, comprising a motorized compressor positioned in a lower region within the stand, an evaporator and motorized beverage pump located in an upper region within the stand, an air-cooled condenser operatively connected with said compressor and evaporator to form said refrigeration system, said condenser including enclosed refrigerant-circulating passages in a broad-area heat-exchange grid array through which air may readily be circulated, means mounting said condenser grid array within said stand substantially horizontally above said compressor and below said evaporator, said condenser grid array being dimensioned and disposed to occupy substantially the full horizontal cross-section of said stand and alone providing passageways in said stand for circulation of air vertically between said lower and upper regions, unbaffled fan means in close proximity to said condenser grid array driven to force air substantially vertically therethrough, and substantially vertical side walls enclosing said stand, including side walls having openings allowing ambient air to be circulated laterally into and out of said upper and lower regions of said stand.

2. Beverage-dispenser apparatus as set forth in claim 1 wherein said motorized beverage pump includes an electric motor having a shaft rotatable about a substantially vertical axis, and wherein said fan means includes an axial-flow assembly of fan blades rotated about said axis by said shaft.

3. Beverage-dispenser apparatus as set forth in claim 2 wherein said axial-flow assembly of fan blades is located in said upper region immediately above said condenser grid array, wherein the horizontal cross-section of said stand is substantially rectangular, and wherein said assembly of fan blades has a diameter substantially spanning the full width of said condenser grid array between parallel oppositely-disposed lateral side walls of said stand, said axis of said shaft being substantially midway between said lateral side walls.

4. Beverage-dispenser apparatus as set forth in claim 2 wherein portions of said condenser grid array in juxtaposition to said fan blades form a substantially flat and horizontal contour.

5. Beverage-dispenser apparatus as set forth in claim 4 wherein said axial-flow assembly of fan blades is located in said upper region immediately above upper portions of said condenser grid array forming said flat and horizontal contour, and wherein said condenser grid array includes turns of refrigerant tubing connected with a multiplicity of heat-conducting heat-transfer members, said array being substantially flat and thin and having a multiplicity of paths therethrough for flow of circulated air substantially vertically between said upper and lower regions.

6. Beverage-dispenser apparatus as set forth in claim 5 wherein said stand is relatively narrow and has a substantially rectangular horizontal cross-section, wherein said condenser grid array has a rectangular outline complementing that of said cross-section, wherein said tubing of said grid array includes a plurality of elongated parallel interconnected lengths extending longitudinally between the front and rear of the stand, and wherein said heat-transfer members are substantially straight laterally-spaced parallel fins extending substantially transversely to said tubing lengths and substantially fully between parallel oppositely-disposed lateral side walls of said stand.

7. Beverage-dispenser apparatus as set forth in claim 6 wherein said assembly of fan blades has a diameter substantially spanning the full width of said condenser grid array between said lateral side walls, wherein end portions of said tubing and end fins associated with said portions of said tubing lie beyond the span of said fan blades in direction longitudinally of said relatively narrow stand, and wherein at least some of said openings in said side walls are disposed alongside said end fins which lie laterally beyond the span of said fan blades and allow ambient air to be swept crosswise of said stand and along surfaces of said end fins to promote air-cooling thereof.

8. Beverage-dispenser apparatus as set forth in claim 7 wherein said end portions of said tubing and said end fins lie at both the front and rear of said stand, and wherein at least some of said openings in said side walls are disposed alongside said end fins at both the front and rear of said stand.

9. Beverage-dispenser apparatus as set forth in claim 8 wherein said openings in said side walls allowing ambient air to be circulated laterally into and out of said upper and lower regions of said stand appear only in said lateral side walls, and wherein said fan blades are shaped and rotated to force air axially downwardly in said stand through said condenser grid array.

10. Beverage-dispenser apparatus of the type including a storage bowl atop a stand housing components of a compression refrigeration system for chilling beverage in the bowl, said stand having certain of said components in upper and lower regions therewithin, an air-cooled condenser grid array of refrigerant tubing and associated heat-transfer fins located at and substantially fully occupying positions between said upper and lower regions and alone providing passageways within said stand for circulation of air vertically between said upper and lower regions, and motorized fan means having unbaffled blades in close proximity to said condenser grid array and operative to draw cooling ambient air laterally into the interior of said stand through vertical side walls thereof and to force the intake of air vertically through said condenser grid array and to exhaust through said side walls the air forced vertically through said condenser grid array, said condenser grid array being operatively connected with components of said compression refrigeration system disposed in said upper and lower regions of said stand, and said side walls through which said ambient air is drawn in and exhausted having openings therethrough accommodating the fan-induced circulation of ambient air between said upper and lower regions of said stand.

* * * * *